US005755208A

United States Patent [19]

Bombarda et al.

[11] Patent Number: 5,755,208

[45] Date of Patent: May 26, 1998

[54] METHOD OF CONTROLLING A NON-RETURN FUEL SUPPLY SYSTEM FOR AN INTERNAL COMBUSTION ENGINE AND A SUPPLY SYSTEM FOR WORKING THE SAID METHOD

[75] Inventors: Giorgio Bombarda, S. Lazzaro Di Savena; Luca Poggio, Spinetta Marengo; Ivano Rosselli, Castelnovo Di Sotto, all of Italy

[73] Assignee: Magneti Marelli, S.p.A., Italy

[21] Appl. No.: 857,263

[22] Filed: May 16, 1997

[30] Foreign Application Priority Data

May 20, 1996 [IT] Italy ..... B096 A 00278

[51] Int. Cl.[6] ..... F02M 51/00

[52] U.S. Cl. ..... 123/478

[58] Field of Search ..... 123/478, 480, 123/492, 493, 479; 73/119 A; 364/431.05, 431.04

[56] References Cited

U.S. PATENT DOCUMENTS

| | | | |
|---|---|---|---|
| 5,211,150 | 5/1993 | Anzai | 123/480 |
| 5,483,938 | 1/1996 | Oshima et al. | 123/478 |
| 5,537,981 | 7/1996 | Suedholt et al. | 123/478 |
| 5,537,982 | 6/1996 | Milunas et al. | 123/492 |
| 5,560,339 | 10/1996 | Yoshioka et al. | 123/478 |
| 5,572,976 | 11/1996 | Minamitani et al. | 123/478 |
| 5,685,276 | 11/1997 | Tanaka et al. | 123/478 |
| 5,687,694 | 11/1997 | Kanno | 123/479 |

FOREIGN PATENT DOCUMENTS

| | | | |
|---|---|---|---|
| 0621405A | 10/1994 | European Pat. Off. | 123/478 |
| 0675277A | 10/1995 | European Pat. Off. | 123/478 |
| 2218828 | 11/1989 | United Kingdom | 123/478 |

*Primary Examiner*—Raymond A. Nelli
*Attorney, Agent, or Firm*—Myers, Liniak & Berenato

[57] ABSTRACT

A non-return fuel supply system for an internal combustion engine operating with at least one cylinder and comprising: at least one intake manifold connected to the cylinder, at least one injector for injecting fuel into the intake manifold, a fuel tank, a pump substantially positioned in the tank in order to deliver fuel to the injector, and a control station comprising a first calculating unit adapted, for each injector, to calculate the value of the average pressure difference between the ends of the injector during each injection phase, and a second calculating unit connected to the first calculating unit and adapted, for each injector, to calculate the average value of the flow rate of the injector during each injection phase on the basis of the value of the average pressure difference between the ends of the injector during the injection phase.

23 Claims, 5 Drawing Sheets

METHOD OF CONTROLLING A NON-RETURN FUEL SUPPLY SYSTEM FOR AN INTERNAL COMBUSTION ENGINE AND A SUPPLY SYSTEM FOR WORKING THE SAID METHOD

BACKGROUND OF THE INVENTION

The invention relates to a method of controlling a non-return fuel supply system for an internal combustion engine.

The invention also relates to a non-return fuel supply system for an internal combustion engine which embodies the cited method.

As is known, an essential component of fuel supply systems is a pump, called the fuel pump, for delivering fuel from the tank to the injectors at a predetermined pressure value. The pressure value is particularly important, in that the delivery characteristics (the flow rate, waiting time, flight time etc.) of an injector depend on the pressure difference between its ends, one communicating with the fuel pump whereas the other is inside the intake manifold.

It is known to use non-return fuel supply systems in which the pump is positioned immediately downstream of the fuel tank whereas the fuel pressure regulator is positioned immediately upstream of the injectors and has a delivery duct and a return duct respectively for transferring fuel from the tank to the regulator and for transferring fuel from the regulator to the tank. The regulator also has a pressure detector in the intake manifold, so as instantaneously to read the value of the pressure in the intake manifold and accordingly adjust the value of the pressure of the fuel at the inlet of the injectors in order to guarantee a constant pressure jump (typically 2.5 bar) between the ends of the injectors so that the delivery characteristics of the injectors are constant.

As is known, in order to limit costs, simplify the construction and avoid a flow of fuel returning from the regulator to the tank via the engine, it has become customary to use non-return fuel supply systems in which the fuel pump and the pressure regulator are both positioned immediately downstream of the fuel tank. In this kind of construction, the regulator does not comprise a pressure detector in the intake manifold, and the delivery pressure of the fuel is kept constant at an absolute value typically between 3 and 3.5 bar.

This solution has the obvious disadvantage of not guaranteeing a constant pressure difference between the ends of the injectors, since the pressure at one end is substantially equal to the delivery pressure of the pump and is therefore constant (relative to the pressure in the fuel tank, which is typically equal to atmospheric pressure) whereas the pressure at the other end is that of the intake manifold and consequently variable during the various operating phases of the engine and depending on variations in atmospheric pressure.

In order to judge the importance of this factor, we shall consider the example illustrated in FIG. 5, which shows the variation in time of the enabling command delivered to an injector (Electric Command), the variation in time of the position of the mechanical valve intercepting the flow of fuel in the injector (Anchor Position), at two different pressure values of the intake manifold (Pman) and at equal delivery pressures of the fuel pump, and the variation in time of the flow rate of the fuel in the injector (Fuel Mass Flow) at the cited two different pressure values of the intake manifold Pman and at equal delivery pressures of the fuel pump (remember that the area subtended by the flow-rate curve is equal to the quantity of fuel injected, marked Q in the drawing). As shown in FIG. 5 and as demonstrated by theoretical studies and experimental evidence, the waiting time (Tw≈400 μsec at 3 bar) is not sensitive to pressure variations whereas the flight time (Tf≈800 μsec at 3 bar) increases in linear manner with the variations in pressure (≈5‰μsec/bar).

To give a clearer idea of the importance of the variation of the pressure in the intake manifold on the flow rate of the injectors, we shall now put forward a numerical example.

Consider a non-return supply system at a fuel delivery pressure (Ppom) of 3 bar, i.e. an absolute pressure of 4 bar (assuming the pressure in the tank Pser is equal to atmospheric pressure, estimated at 1 bar). Theoretical studies and experimental evidence show that the flow rate of fuel Q varies as a first approximation with the square root of the difference in pressure between the ends of the injectors. If we consider operation of the engine under transient conditions, we may assume that, under the worst conditions, the pressure in the intake manifold will change by 200 mbar at the PMS (=top dead centre position), i.e. every 180° of rotation of the drive shaft. If we assume that the pressure in the tank (Pser) is typically equal to atmospheric pressure (assumed equal to 1000 mbar) and the pressure in the intake manifold is typically around 500 mbar, we can assume a variation in the pressure around the said value, more specifically between a first value (Pman1) of 600 mbar and a second value (Pman2) of 400 mbar.

DQ=SQR(P2/P1)=
=SQR(Ppom+Pser−Pman2)/(Ppom−Pser-Pman1)=
=sqr((3000+1000−400)/(3000+1000−600))=
=1.029≈3%

A 3% difference in the quantity of injected fuel is significant and considerably greater than the error introduced by the pressure regulator, in that pressure regulators at present in use introduce an error of not more than 0.3% in the value of the delivery pressure.

This variation in the pressure jump is particularly harmful in that it introduces a significant error regarding the quantity of fuel injected into the cylinder and it is therefore impossible to obtain the required ratio between the amount of air and the amount of fuel, thus disadvantageously affecting combustion with particularly harmful consequences, i.e. increased consumption, loss of power, and improper operation of the emission-eliminating means (typically the exhaust catalyst).

SUMMARY OF THE INVENTION

The object of the invention therefore is to provide a method of control and the associated non-return fuel supply system for an internal combustion engine, and free from the disadvantages described hereinbefore.

The invention provides a method of controlling a non-return fuel supply system for an internal combustion engine, the fuel supply system operating with at least one cylinder and comprising at least one intake manifold connected to the cylinder, at least one injector for injecting fuel into the intake manifold, a fuel tank, and a pump substantially positioned in the tank in order to deliver fuel to the said injector; the said method being characterised in that, for each injector, it comprises the following phases: calculating the anticipated value of the next injection phase; based on the anticipated value, calculating an estimated value of the average pressure in the intake manifold during the injection phase; calculating the value of the average pressure difference between the ends of the injector during the injection phase and based on the estimated value of the average pressure in the intake manifold during the injection phase; based on the value of the said average pressure difference between the ends of the injector during the injection phase, calculating the value of the average flow rate of the injector during the injection phase, calculating the quantity of fuel to be injected; and calculating the injection time on the basis of the value of the flow rate of the injector and the value of the quantity of fuel to be injected.

According to the invention, a non-return fuel supply system for an internal combustion engine is also constructed, operating with at least one cylinder and comprising at least one intake manifold connected to the said cylinder, at least one injector for injecting fuel into the said intake manifold, a fuel tank, a pump positioned substantially in the tank for delivering fuel to the injector, and a control station; the system being characterised in that the said station comprises: a first calculating unit adapted, for each injector, to calculate the value of the average pressure difference between the ends of the injector during each injection phase, and a second calculating unit adapted, for each injector, to calculate the average value of the flow rate of the injector during each injection phase based on the value of the average pressure difference between the ends of the injector during the injection phase; the said second calculating unit being connected to the said first calculating unit.

BRIEF DESCRIPTION OF THE DRAWINGS

The invention will be more clearly understood from the following description of a preferred embodiment, by way of non-limitative example only, with reference to the accompanying drawings in which.

DETAILED DESCRIPTION OF THE INVENTION

Figure 1:
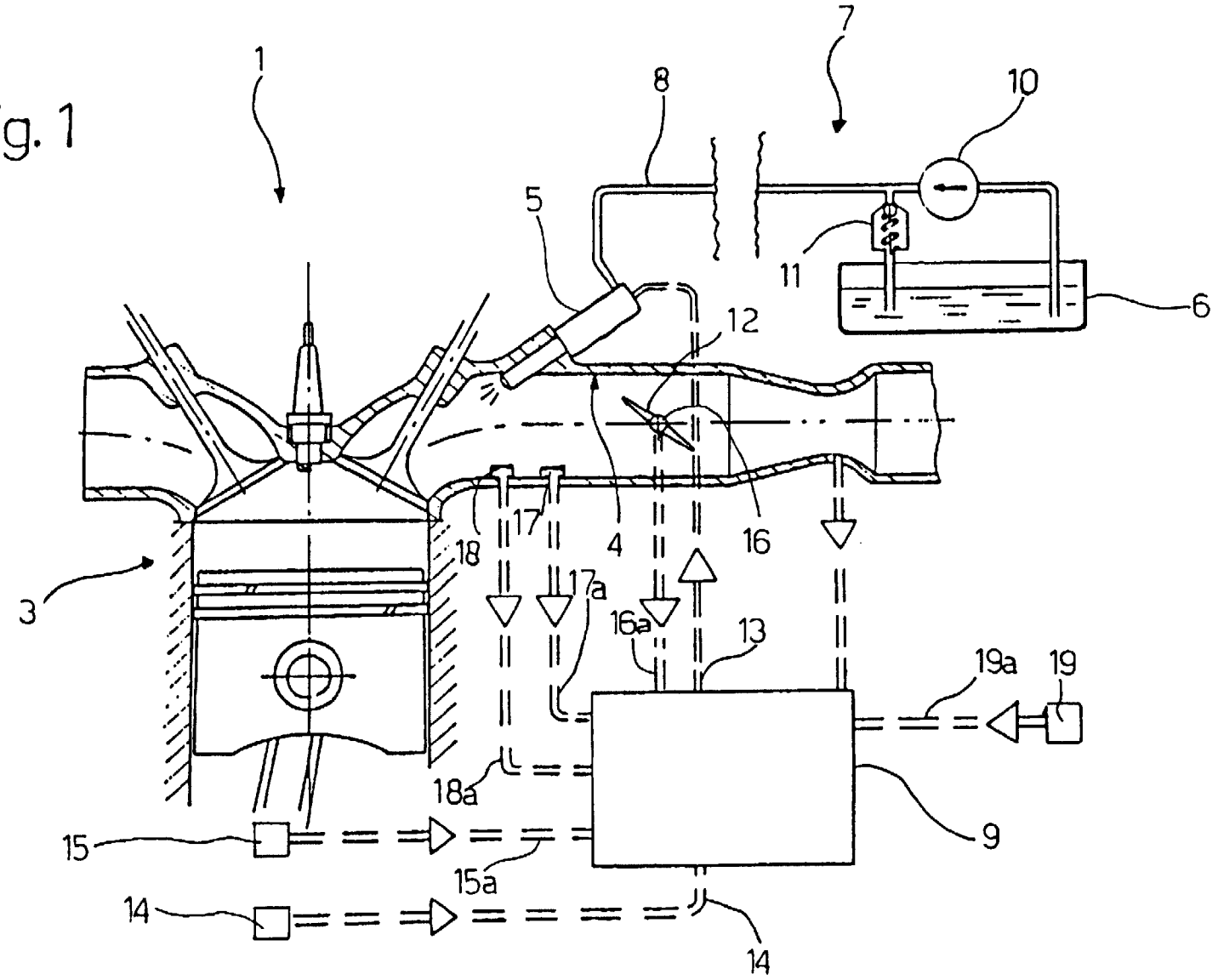
FIG. 1 is a diagram of a preferred embodiment of the fuel supply system according to the invention.

In FIG. 1, reference 1 denotes an internal combustion engine comprising a non-return fuel supply system 2. The engine 1 has at least one cylinder 3 communicating with a respective intake manifold 4 ending in a suction valve in the cylinder 3 and containing at least one injector 5 for injecting fuel into the intake manifold 4; a fuel tank 6, a fuel pump 7 positioned substantially in the tank 6 in order to deliver fuel to the injector 5 via a delivery duct 8, and a control station 9.

The fuel pump 7 comprises a pump 10 operating at a pressure typically between 4 and 6 bar, and a pressure regulator 11 for maintaining the fuel delivery pressure at a constant value (typically between 3 and 3.5 bar relative to the pressure in the fuel tank).

The intake manifold 4 contains the injector 5 and also contains a butterfly valve 12. In the case of multipoint injection engines, i.e. with one injector for each cylinder 3, the injectors 5 are normally (as shown in FIG. 1) positioned as near as possible to the suction valve, whereas in the case of single-point injection engines, i.e. with a single injector for all the cylinders 3, the injector 5 is normally positioned immediately upstream of the butterfly valve 12.

The control station 9 has various input and output connections for controlling all operations of the engine 1. FIG. 1 shows only those connections which are relevant to the description of the present invention. More particularly, 13 denotes the connection between the control station 9 and the injector 5 whereby the control station controls the operation of the injector 5. The diagram also shows connections from other sensors of known kind and present in the motor 1 for measuring some parameters; more particularly 14*a* denotes the connection to a sensor 14 for detecting the speed of rotation of the drive shaft, 15*a* denotes the connection to a sensor 15 for detecting the temperature of the cooling liquid, 16*a* denotes the connection to a sensor 16 for detecting the position of the butterfly valve 12, 17*a* denotes the connection to a sensor 17 for detecting the temperature of the air in the intake manifold 4, 18*a* denotes the connection to a sensor 18 for detecting the pressure of the air in the intake manifold 4, and 19*a* denotes the connection to a sensor 19 for detecting the battery voltage. The sensor 18 for detecting the pressure of the air in the intake manifold 4 is positioned opposite the injector 5, so as to detect the pressure in that zone of the manifold 4 nearest the injector 5.

Figure 3:
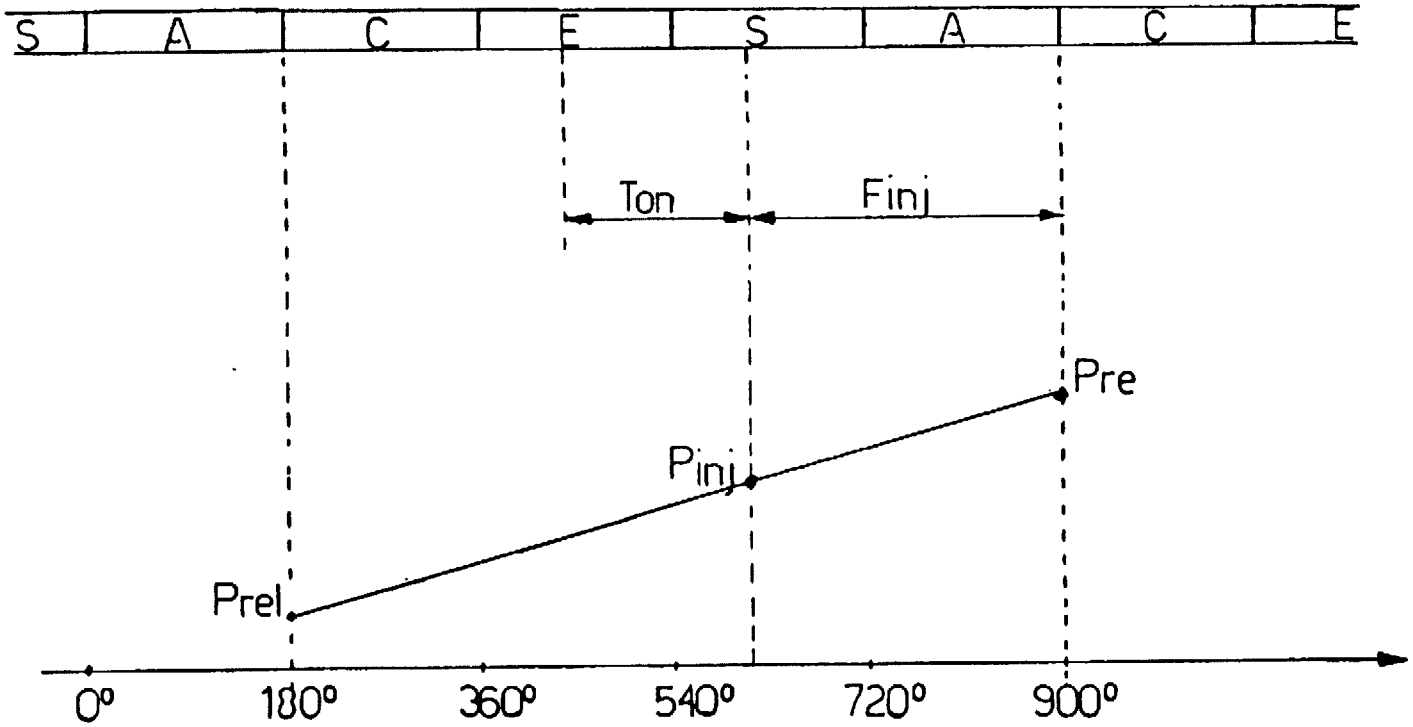
FIG. 3 is a diagram of an operating cycle of an engine, showing some quantities relating to the system in FIG. 1.

As shown in FIG. 3, in the description hereinafter the operating cycle of a cylinder will be expressed in mechanical degrees, i.e. a complete operating cycle comprising the four phases (suction, compression, expansion and exhaust) has a total duration of 720° from the first instant after the beginning of the suction phase.

Figure 2:
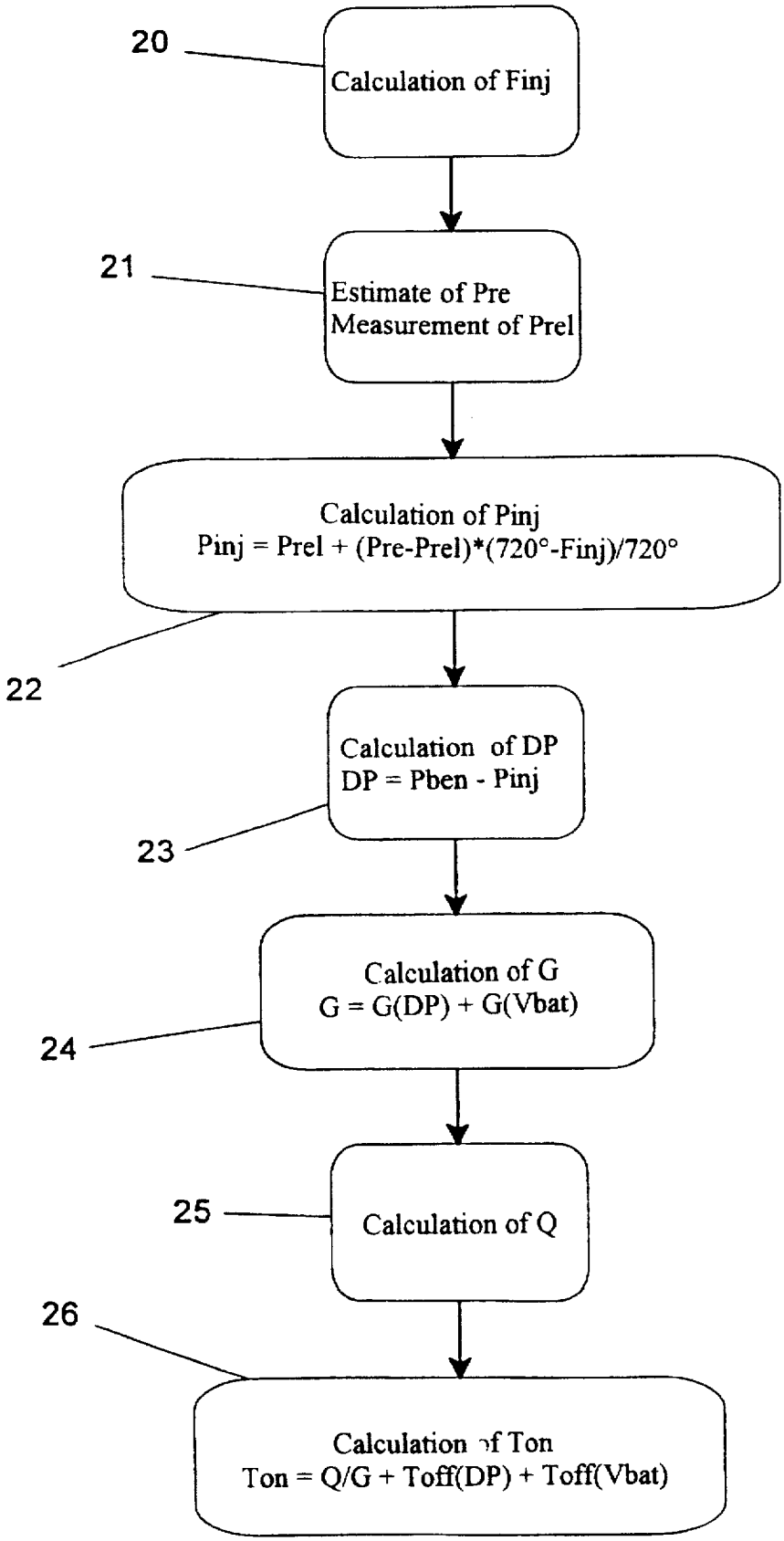
FIG. 2 is a block diagram of the method of control according to the invention.

Referring more particularly to FIG. 2, we shall now describe the control procedure, also a subject of the invention, for the fuel supply system 2 of the engine 1.

The control procedure according to the invention will now be described with particular reference to the engine 1 illustrated in FIG. 1, which is provided with a multi-point injection system, i.e. one injector 5 for each cylinder 3, without thereby losing generality, since only slight, non-substantial modifications, as will be seen hereinafter, are needed for applying the procedure to a motor 1 provided with a single-point injection system, i.e. a single injector 5 for all the cylinders 3.

The control procedure according to the invention provides a series of operations, marked by blocks from 20 to 26, for each injector 5, in order to control the injector 5 on the basis of values of the real flow rate estimated on the basis of the actual pressure jump between the ends of the injector 5.

The procedure starts from a block 20 in which the cylinder 3 belonging to the injector 5 is completing as suction phase; at this moment, in accordance with known methods long used in normal production, the control station 9 calculates the anticipated value of the injection (Finj) for the next suction phase, i.e. the interval between the instant of the actual end of the injection phase (Ton) and the instant of the theoretical end thereof (coinciding with the end of the suction phase). The anticipated value of the injection is normally expressed in degrees. The instant of the theoretical end of the injection phase coincides with the end of the suction phase in the next cycle, i.e. corresponds to a mechanical angle of 900°.

From block 20, the procedure passes to a block 21 in which the control station 9, via the pressure sensor 18, reads the pressure in the intake manifold 4 at the end of the current suction phase (Prel) of the cylinder 3. The control station 9, by known methods, then estimates a pressure in the intake manifold 4 at the end of the next suction phase of the cylinder 3 (Pre).

As described in detail hereinafter, one method which can be used for estimating the said pressure is that proposed in Italian patent application TO94A000152 dated 4 Mar. 1994 (this patent application has been extended, resulting in the following patent applications: EP 95 102 976.8 dated 2 Mar. 1995, U.S. Ser. No. 08/397,386 dated 2 Mar. 1995, BR 9500900.0 dated 3 Mar. 1995).

From block 21 the procedure passes to a block 22 which, by known methods, estimates an average pressure in that zone of the intake manifold 4 nearest the injector 5 during the injection phase (Pinj). Theoretical calculations and practical evidence have shown that the pressure variations in the intake manifold 4 during the injection phase are small, and consequently the average pressure in that zone of the intake manifold 4 nearest the injector 5 during the injection phase may at a first approximation be regarded as constant. The pressure value may therefore be assumed equal to the pressure at the end of the injection phase, i.e. Finj degrees before the end of the next suction phase.

The pressure in the manifold 4 at the end of the injection phase is determined by interpolating the curve showing the variation of the pressure in the manifold 4 at the instant when the injection phase ends, this instant being known since the anticipated value of the injection (Finj) is known. The curve of the variation of pressure in the manifold 4 during the engine operating phases (suction, compression, expansion and exhaust) is of known behaviour and is adapted on the basis of two outline values: i.e. the measured pressure in the intake manifold 4 at the end of the preceding suction phase (Prel) and the estimated pressure in the intake manifold 4 at the end of the next suction phase (Pre). As a first approximation it is estimated that the variation of the pressure in the intake manifold 4 is linear, as illustrated in FIG. 3. FIG. 3 shows the points relating to the two imposed outline conditions (Prel and Pre) and to the conditions interpolated at the end of the injection phase (Pinj).

The pressure in the intake manifold 4 at the end of the injection phase is given by the formula:

$$Pinj=Prel+(Pre-Prel)*(720°-Finj)/720°$$

From block 22, the procedure passes to a block 23 in which the control station 9 calculates the estimated value of the average pressure difference between the ends of the injector 5 during the injection phase DP. This value is obtained by subtracting the estimated average pressure in that zone of the intake manifold 4 nearest the injector 5 during the injection phase from the absolute pressure of the fuel upstream of the injector 5 (Pben). The absolute pressure of the fuel upstream of the injector 5 is obtained by summing the pressure present in the tank 6 (Pser) and the value of the pressure jump imposed by the pressure regulator 11 of the fuel pump 7 (Ppom). The formula used is therefore:

$$DP=Pben-Pinj=Ppom+Pser-Pinj$$

The value of the pressure jump imposed by the pressure regulator 11 is known and constant within the errors of the device (0.3%). The value of the fuel pressure in the tank 6 (Pser) can be assumed equal to atmospheric pressure, or a suitable pressure sensor (not illustrated) can be provided and reads the pressure inside the tank 6 and transmits it to the station 9 in order more accurately to calculate the value of the pressure jump between the ends of the injector 5.

From block 23 the procedure passes to a block 24 in which the control station 9, on the basis of the value of the average pressure difference between the ends of the injector 5 during the injection phase, calculates the value of the average flow rate of the injector during the injection phase (G). This calculation is made by interpolation on two-dimensional flow rate and pressure-difference curves stored in the control station 9 and obtained by theoretical calculations and experimental evidence during the design phase for the engine 1.

As is known, variations in the battery voltage can result in appreciable differences in the flow rate of the fuel pump 10 and consequently in the flow rate of the injector 5, since the power of the pump 10 varies with the square of the battery voltage. To take account of this factor also, the control station 9, before calculating the average flow rate of the injector 5, also reads the battery voltage (Vbat) and then interpolates in three-dimensional flow rate/pressure difference/voltage curves. The general formula used is therefore as follows:

$$G=G(DP)+G(Vbat)$$

From block 24 the procedure passes to a block 25 in which the control station 9, by known methods long used in normal production, calculates the quantity of fuel to be injected into the cylinder 3 (Q).

From block 25 the procedure passes to a block 26 in which the control station 9 calculates the injection time, i.e. the time during which the injector is activated. The injection time is calculated by summing a term given by the quotient of the value of the quantity of fuel for injecting into the cylinder 3 and the value of the average flow rate of the injector 5 during an injection phase, together with an offset term (Toff). The offset term takes account of transient conditions (typically the waiting time and the flight time) on the quantity of fuel injected by the injector 5. Allowing only for the pressure difference between the ends of the injector 5, the offset term is estimated by interpolation on two-dimensional time/pressure difference curves stored in the control station 9 and obtained by theoretical calculations and experimental evidence during the planning phase of the engine 1. Taking account also of the battery voltage, the last-mentioned term is estimated by interpolation on three-dimensional time/pressure difference/voltage curves or alternatively by adding a term obtained by interpolation on two-dimensional time/pressure difference curves to a term obtained by interpolation on two-dimensional time/voltage curves. The general formula used therefore is as follows:

$$Tinj=Q/G+Toff=Q/G+Toff(DP)+Toff(Vbat)$$

In the case of a single-point motor 1, i.e. with a single injector 5 for all the cylinders 3, the previously-described procedure and device undergo marginal changes; the flow rate of the injector 5 on the basis of the pressure difference and optionally based on the voltage is made by the same methods as used in the case of multi-point injection, and the estimate is repeated for each cylinder 3 or for all the cylinders 3 in phase with one another, i.e. at a frequency equal to a multiple of the frequency at which the estimate is repeated in the multi-point case.

Figure 4:
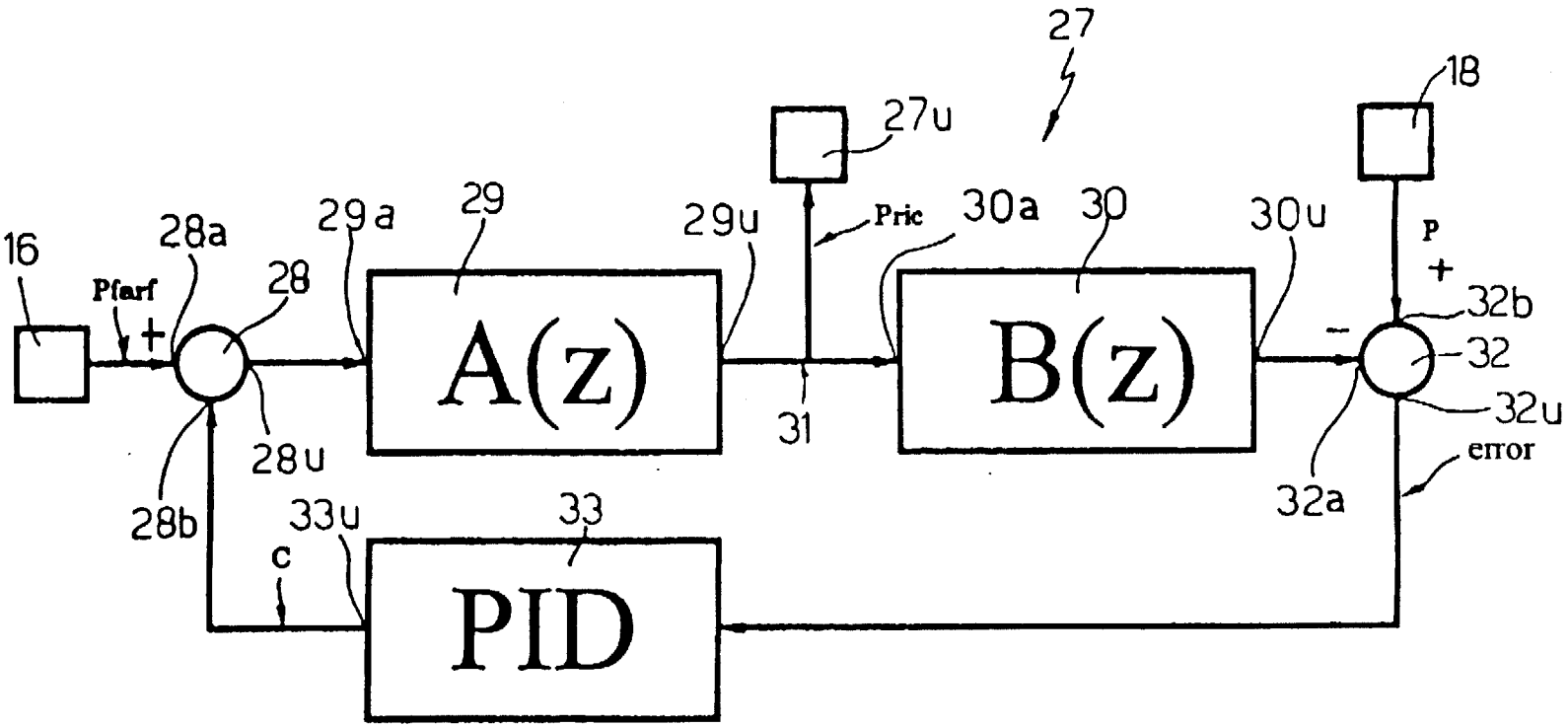
FIG. 4 is a block diagram showing the operation of a particular calculating unit in the system in FIG. 1.
Figure 5:
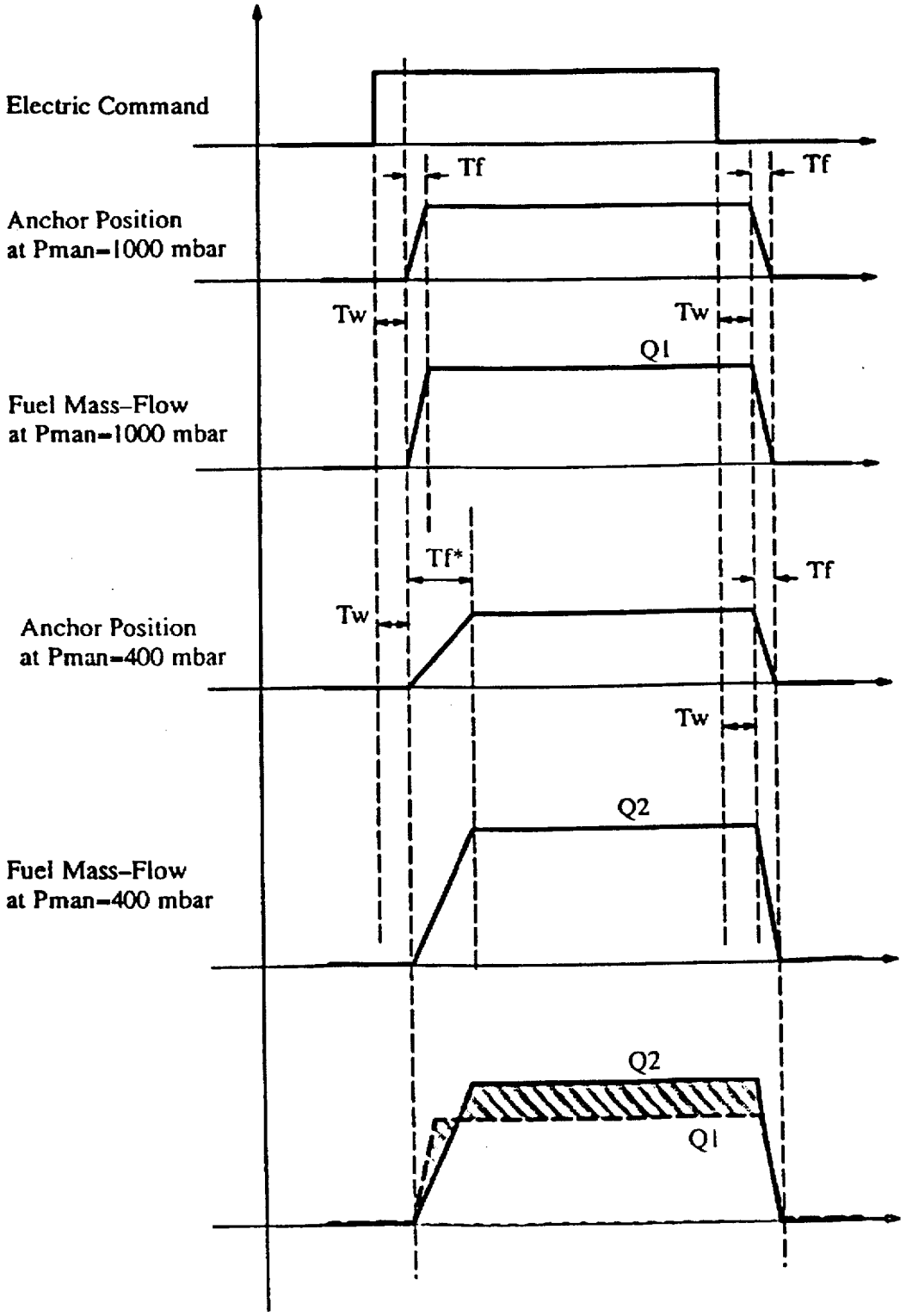
FIG. 5 is a multiple diagram of the variation in time of some quantities relating to the system in FIG. 1.

With particular reference to FIG. 4, we shall now describe the method and circuit proposed for estimating the pressure in the intake manifold 4 at the end of the suction phase.

This method requires a knowledge of five operating parameters of the motor 1, i.e. the speed of revolution of the motor (n), the temperature of the cooling liquid (TH20), the position of the butterfly valve (Pfarf), the pressure of the air sucked by the manifold 4 (P) and the temperature of the air sucked by the manifold 4 (T).

FIG. 4 is a block diagram of an estimating circuit 27 for estimating the pressure in the intake manifold 4 at the end of the next suction phase.

The circuit 27 comprises a summation unit 28 which has a first summing input (+) 28*a* which receives the signal Pfarf generated by the sensor 16, and also has an output 28*u* connected to an input 29*a* of a circuit 29. The circuit 29 embodies a transfer function A(z) which models a transmission means, more particularly the portion of the suction collector 4 between the butterfly valve 12 and the sensor 18 for reading the pressure in the intake manifold 4. The transfer function A(z) is advantageously embodied by a digital filter, more particularly a low-pass filter having coefficients depending on the signals N, TH20 and T generated by respective sensors 14, 15 and 17.

The circuit 27 also comprises a circuit 30 having an input 30*a* connected to an output 29*u* of the circuit 29 via a line 31. The line 31 communicates with the output 27*u* of the circuit 27. The circuit 30 embodies a transfer function B(z) which models the delays by the sensor 18 for reading the pressure in the intake manifold 4, the delays in signal processing (filtering, conversion and processing of the engine load signal) and delays due to the physical injection process.

The transfer function B(z) is advantageously embodied by a digital filter, more particularly a low-pass filter having coefficients which depend on the signals N, TH20 and Taria generated by respective sensors 14, 15 and 17.

The circuit 30 has an outlet 30*u* connected to a first subtracting input 32*a* of a unit 32 which also has a second summation input 32*b* supplied with the engine load signal used in the station 7 and comprising all the delays by the system.

The summation unit 32 also has an output 32*u* connected to an input of a correction circuit 33, advantageously made up of a proportional integral derivative network (PID) having an output 32*u* which communicates with a second input 28*b* of the unit 28.

In operation, the input of the circuit 29 receives the signal Pfarf corrected by a correction signal C generated by the circuit 33, and at its output generates a signal which estimates the pressure in the intake manifold 4 near the pressure sensor 18 at the end of the next suction phase. The signal Pric output by the circuit 29 is then supplied to the circuit 30 which outputs a signal giving the pressure of the intake manifold 4 including the inertia in the response of the pressure sensor, the delays in the system and the delays in actuation. The output signal from the circuit 30 is then compared with the (real) signal giving the pressure in the intake manifold 4 generated by the sensor 18, so that an error signal appears at the output of unit 32 and is then processed by the circuit 33, which in turn outputs the signal C.

The feedback from the circuit 33 reduces the error signal, and consequently the signal Pric at the output of the circuit 29 is a measurement of the pressure in the intake manifold 4 minus the delays of the sensor, the delays of the calculating system and the delays in actuation.

The method, and consequently the system according to the invention, has numerous advantages in that it implements a method of estimating the effective pressure difference at any instant between the ends of the injectors, and provides a means of accurately determining the instantaneous flow rate of the injectors, so that the necessary quantity of fuel can be injected into the cylinder with much more restricted errors than in conventional systems. This feature is shown by an improvement in the overall performance of the engine (power, consumption and exhaust emission).

Furthermore the method proposed by the invention can be performed at limited cost, since the required calculating power is very limited and the required input values are normally already monitored in internal combustion engines at present on sale, and consequently it is not necessary to add new sensors.

Finally, the fuel supply system described and illustrated here can of course be varied and modified.

For example in the case of a number of injectors (multipoint injection) the various injectors 5 can receive fuel not directly from the delivery duct 8 of the fuel pump 7 but via a chamber, called the fuel manifold, disposed near the injectors 5 and supplied by the delivery duct 8 of the fuel pump 7.

We claim:

1. A method of controlling a non-return fuel supply system for an internal combustion engine comprising at least one cylinder (3), the fuel supply system (2) comprising at least one intake manifold (4) connected to the cylinder (3); at least one injector (5) for injecting fuel into the intake manifold (4); a fuel tank (6); and a pump (7) positioned in the tank (6) in order to deliver the fuel to the injector (5); the method being characterised in that for each injector (5) it comprises the steps of calculating an anticipated value (Finj) of the next injection phase; calculating an estimated value of an average pressure in the intake manifold (4) during the said injection phase (Pinj) based on the anticipated value; calculating an average value of a pressure difference between an input end and an output end of the injector (5) during the injection phase based on the estimated value of the average pressure in the intake manifold (4); calculating the value of an average flow rate of the injector (5) during the said injection phase in dependence on the said average value of the said pressure difference; and calculating an injection time based on the said value of the flow rate of the injector (5) and on a value of the quantity of fuel to be injected.

2. A method according to claim 1, characterised in that it comprises two additional phases preceding the said phase for calculating the said estimated value of the average pressure in the intake manifold (4); the first of the two phases being a phase for calculating an estimated value of the pressure in the intake manifold (4) at the end of the next first suction phase of the cylinder (3), and the second of the said two phases being a phase for measuring a value of the pressure in the intake manifold (4) at the end of a second suction phase of the cylinder (3) before the said first suction phase.

3. A method according to claim 2, characterised in that the said estimated value of the pressure in the intake manifold (4) at the end of the said first suction phase is calculated on the basis of the speed of revolution of the engine (1) based on the value of the temperature of the cooling liquid, based on the position of the butterfly valve (12), based on the value of the pressure of the air sucked by the intake manifold (4) and based on the value of the temperature of the air sucked by the intake manifold (4).

4. A method according to claim 2, characterised in that the said estimated value of the average pressure in the intake manifold (4) during the injection phase is calculated not only on the basis of the said anticipated value but also based on the said measured value of the pressure in the intake manifold (4) and based on the said estimated value of the pressure in the intake manifold (4) at the end of the first suction phase of the said cylinder (3).

5. A method according to claim 4, characterised in that the said estimated value of the average pressure in the intake manifold (4) during the said injection phase is assumed equal to a value of the pressure in the intake manifold (4)

existing at the beginning of the injection phase; this value being obtained by interpolation, at an initial instant of the said first suction phase, between the said measured value of the pressure in the intake manifold (4) and the said estimated value of the pressure in the intake manifold (4) at the end of the said first suction phase.

6. A method according to claim 5, characterised in that the said interpolation is linear.

7. A method according to claim 1, characterised in that the said average value of a pressure difference at the end of the injector (5) is calculated by subtracting the said estimated value of the average pressure of the intake manifold (4) from a value of the absolute pressure of the fuel at the said input end of the injector (5).

8. A method according to claim 7, characterised in that the said value of the absolute pressure of the fuel at the said input end of the injector (5) is obtained by adding a value of the pressure jump imposed on the fuel by the said pump (7) to the value of the pressure in the tank (6).

9. A method according to claim 1, characterised in that the engine (1) has a battery which supplies energy to the fuel pump (10); the said method comprising an additional phase for measuring a value of the battery voltage preceding the said phase of calculating the average flow rate of the injector (5).

10. A method according to claim 9, characterised in that the said value of the average flow rate of the injector (5) during the injection time is calculated on the basis of the said average value of the pressure difference between the ends of the injector (5) during the said injection phase and also based on the said value of the battery voltage.

11. A method according to claim 10, characterised in that the said value of the average flow rate of the injector (5) during the injection time is calculated by adding a first term, estimated in dependence on the said average value of the pressure difference between the ends of the injector (5) during the said injection phase, to a second term estimated on the basis of the said value of the battery voltage.

12. A method according to claim 1, characterised in that the said value of the injection time is calculated by dividing the said value of the quantity of fuel for injection by the said value of the flow rate of the injector (5).

13. A method according to claim 1 characterised in that the said value of the injection time is calculated by dividing the said value of the quantity of fuel for injection by the said value of the flow rate of the injector (5) and adding the said quotient to an offset value estimated on the basis of the said average value of the pressure difference between the ends of the injector (5).

14. A method according to claim 9, characterised in that the said value of the injection time is calculated by dividing the value of the quantity of fuel for injection by the value of the flow rate of the injector (5) and adding the said quotient to an offset value estimated on the basis of the value of the battery voltage.

15. A method according to claim 9, characterised in that the said value of the injection time is calculated by dividing the said value of the quantity of fuel for injection by the said value of the flow rate of the injector (5) and adding the said quotient to a first offset value estimated on the basis of the said average value of the pressure difference between the ends of the injector (5) and a second offset value estimated on the basis of the said value of the battery voltage.

16. A non-return fuel supply system for an internal combustion engine comprising at least one cylinder (3); the said supply system comprising at least one intake manifold (4) connected to the said cylinder (3); at least one injector (5) for injecting fuel into the said intake manifold (4) and having an input end and an output end for fuel; a fuel tank (6); a pump (7) positioned in the tank (6) in order to deliver fuel to the injector (5); and a control station (9); the said system being characterised in that the said control station (9) comprises: a first calculating unit adapted, for each injector (5), to calculate an average value of the difference in pressure between the said ends of the injector (5) during an injection phase, and a second calculating unit adapted, for each injector (5), to calculate an average value of the flow rate of the injector (5) during the said injection phase based on the said average value of the pressure difference; the second calculating unit being connected to the said first calculating unit.

17. A system according to claim 16, characterised in that the said first calculator unit comprises a reconstructing circuit (27) adapted to estimate the pressure in the said intake manifold (4) at the end of the next suction phase of the said engine (1).

18. A system according to claim 17, characterised in that the said reconstructing circuit (27) is connected to a first sensor (14) adapted to measure the value of the speed of rotation of the engine (1) and a second sensor (15) adapted to measure the temperature of the cooling liquid, a third sensor (16) adapted to measure the position of the butterfly valve (12), a fourth sensor (18) adapted to measure the value of the air pressure sucked by the intake manifold (4), and a fifth sensor (17) adapted to measure the value of the temperature of the air sucked by the intake manifold (4).

19. A system according to claim 18, characterised in that the said reconstructing circuit (27) comprises:

first summation means (28) having a first input (28*a*) which receives a signal (Pfarf) generated by the said third sensor (16) and adapted to monitor the opening of the butterfly valve (12);

first modelling means (29) having their input (29*a*) connected to an output of the said first summation means (28);

the said first modelling means (29) embodying a first transfer function (A(z)) which models a transmission means, more particularly the portion of the intake manifold (4) between the said fourth sensor (18) and the said butterfly valve (12);

second modelling means (30) having their input (30*a*) connected to an output (29*u*) of the said first modelling means (29);

said second modelling means (30) embodying a second transfer function (B(z)) which models the delays of the said fourth sensor (18), the delays in processing by the system and the delays due to the injection process;

second summation means (32) having a first input (32*b*) which receives the signal giving the value of the pressure in the said intake manifold (4) generated by the said fourth sensor (18) including all the delays in the system and a second input (32*a*) communicating with an output (30*u*) of the said second modelling means (30);

the said second summation means (32) having an output (32*u*) which generates an error signal supplied to a compensation network (33), particularly a PID network, having an output (33*u*) adapted to supply a feedback signal (C) to a second input (28*b*) of the said first summation means (28);

the said pressure-reconstructing means (27) generating the said correct engine load signal (Pric) at the output (29*u*) of the said first modelling means (29).

20. A system according to claim 19, characterised in that the said first modelling means (29) comprise a digital filter, more particularly a low-pass filter, which embodies the said first transfer function (A(z)).

21. A system according to claim 20, characterised in that the said second modelling means (30) comprise a digital filter, more particularly a low-pass filter, which embodies the said second transfer function (B(z)).

22. A system according to claim 16, characterised in that the said motor (1) comprises a battery; the said second said calculating unit is connected to a sixth sensor (19) adapted to measure a voltage of the said battery and the said second calculating unit makes the said calculation of the said average value of the flow rate of the injector (5), also based on the value of the battery voltage.

23. A system according to claim 16, characterised in that it comprises a seventh sensor connected to the said station (9) and positioned in the said tank (6) in order during operation to read a value of the pressure in the tank (6).

* * * * *